US007553191B2

(12) United States Patent
Su et al.

(10) Patent No.: US 7,553,191 B2
(45) **Date of Patent: *Jun. 30, 2009**

(54) PLUG CONNECTOR WITH IMPROVED CABLE ARRANGEMENT

(75) Inventors: Ping-Sheng Su, Tu-Cheng (TW); Jie Cheng, Kunshan (CN); Hong-Lei Fan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/074,299

(22) Filed: Mar. 3, 2008

(65) Prior Publication Data

US 2008/0214054 A1 Sep. 4, 2008

(30) Foreign Application Priority Data

Mar. 2, 2007 (CN) ..... 2007 2 0034872

(51) Int. Cl.
*H01R 24/00* (2006.01)

(52) U.S. Cl. ..... 439/637; 439/497; 439/564

(58) Field of Classification Search ..... 439/460, 439/492–499, 604, 606, 564, 579, 637–639
See application file for complete search history.

(56) References Cited

U.S. PATENT DOCUMENTS

| | | | | |
|---|---|---|---|---|
| 6,210,204 | B1 * | 4/2001 | Ko et al. | 439/404 |
| 6,739,883 | B1 * | 5/2004 | Cheng et al. | 439/98 |
| 6,746,281 | B1 * | 6/2004 | Zhang | 439/637 |
| 6,824,426 | B1 * | 11/2004 | Spink, Jr. | 439/579 |
| 7,083,465 | B2 * | 8/2006 | Wu | 439/497 |
| D530,674 | S * | 10/2006 | Ko | D13/147 |
| 7,435,129 | B2 * | 10/2008 | Su et al. | 439/483 |
| 2006/0079119 | A1 * | 4/2006 | Wu | 439/492 |
| 2008/0188136 | A1 * | 8/2008 | Su et al. | 439/660 |
| 2008/0214054 | A1 * | 9/2008 | Su et al. | 439/637 |

FOREIGN PATENT DOCUMENTS

CN 1707869 A 12/2005

* cited by examiner

*Primary Examiner*—James Harvey
(74) *Attorney, Agent, or Firm*—Wei Te Chung

(57) ABSTRACT

A plug connector (100) includes an insulative housing (1) including a base portion (10) and a mating portion (12) extending from the base portion in a first direction, a number of contacts (2) received in the insulative housing; and a number of wires (3) comprising a number of signal wires (31) and a number of power wires (32) respectively electrically connecting with the contacts. The signal wires and the power wires are both arranged to extend along second opposite directions perpendicular to the first direction of the mating portion to locate at opposite sides of the mating portion.

19 Claims, 13 Drawing Sheets

PLUG CONNECTOR WITH IMPROVED CABLE ARRANGEMENT

BACKGROUND OF THE INVENTION

1. Field of the Invention

The present invention generally relates to a plug connector, and more particularly to a plug connector in accordance with SAS (Serial Attached SCSI; Serial Attached Small Computer System Interface) or Serial ATA standard.

2. Description of Related Art

Today, computer has been widely used in the fields, such as electronic commerce, family internet, internet station etc. Each computer has a data storage center, such as hard disk. The software and data information are stored in the hard disk. When working, the CPU (Center Processing Unit) of the computer constantly visits the hard disk to search the data needed or stores the data to the hard disk. For compatibility, the connector of the hard disk usually complies with particular interface standard. SCSI series and ATA series are the most two famous interface standards so far.

Serial Attached SCSI is developed from parallel SCSI. Besides the advantages of higher signal transmission speed, the most important advantage is that SAS interface is compatible with SATA interface. That is to say, if the system permits, the plug connector with SATA interface can be plugged into the socket connector with SAS interface.

China patent Publication No. 1707869A discloses a plug connector in accordance with SAS interface. The plug connector comprises signal wires and power wires which both extend from the same side of the plug connector along mating direction. However, the inner space in the case of a server or PC is decreased gradually with the development of electronics, thus, particular cable arrangement manner is needed to satisfy the current demands. In some cases, the arrangement of the signal and power wires stated above cannot meet the requirements. In addition, such cable arrangement manner is inconvenient in assembly and occupies relatively big space in the case. Even the signal and power wires are bent to meet the limited space in the case, the bent direction of the wires only is a single direction which also cannot meet some particular requirements.

Correspondingly, it is desired to have a plug connector with improved cable arrangement to address the problems stated above.

BRIEF SUMMARY OF THE INVENTION

Accordingly, an object of the present invention is to provide a plug connector with improved cable arrangement for convenient use.

In order to achieve the above-mentioned object, a plug connector in accordance with the present invention comprises an insulative housing comprising a base portion and a mating portion extending from the base portion in a first direction, a plurality of contacts received in the insulative housing, and a plurality of wires comprising a plurality of signal wires and a plurality of power wires respectively electrically connecting with the contacts. The signal wires and the power wires are both arranged to extend along second opposite directions perpendicular to the first direction of the mating portion to locate at opposite sides of the mating portion.

Other objects, advantages and novel features of the invention will become more apparent from the following detailed description of the present embodiment when taken in conjunction with the accompanying drawings.

DETAILED DESCRIPTION OF THE INVENTION

Figure 1:
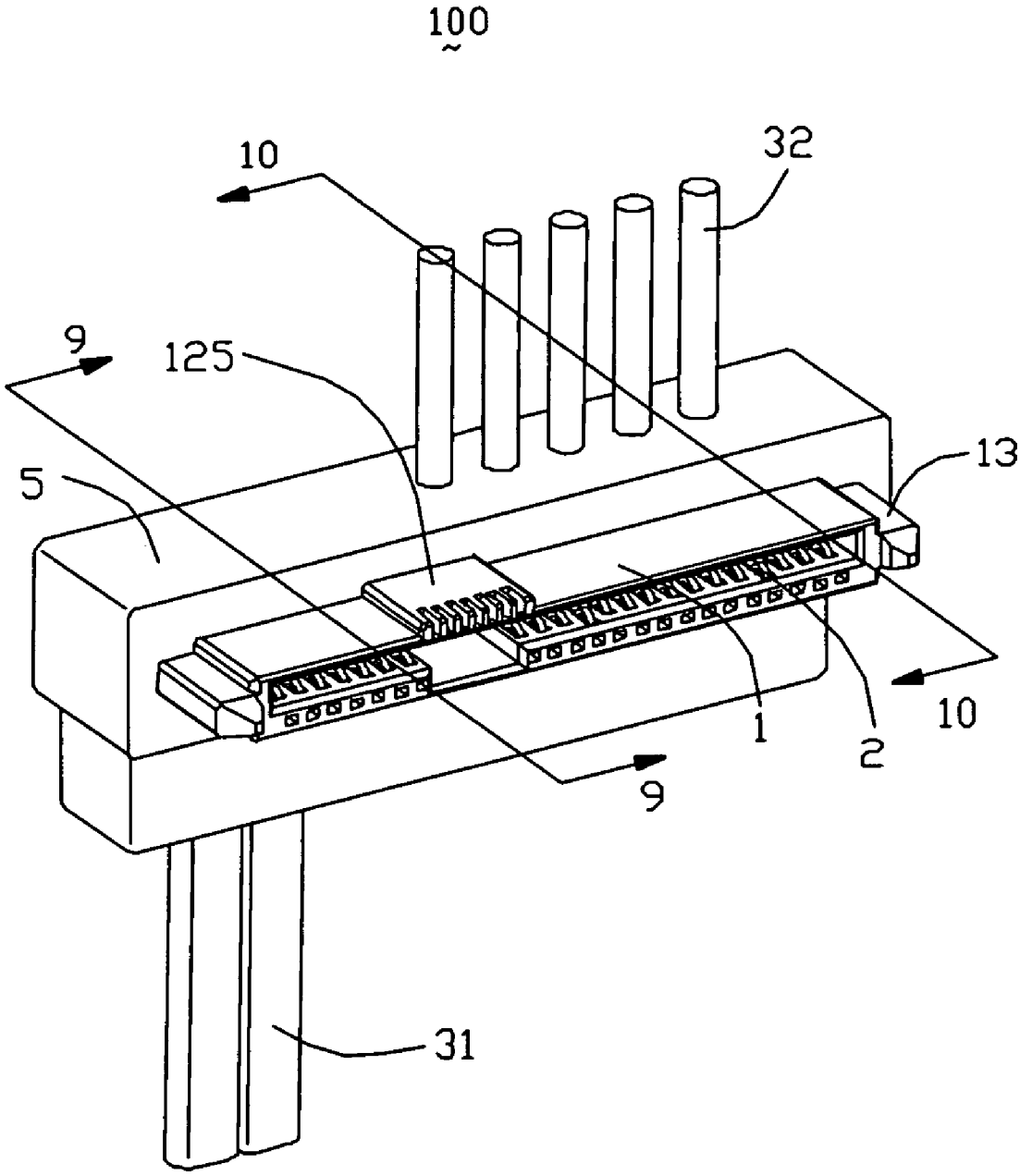
FIG. 1 is an assembled, perspective view of a plug connector in accordance with the first embodiment of the present invention.
Figure 2:
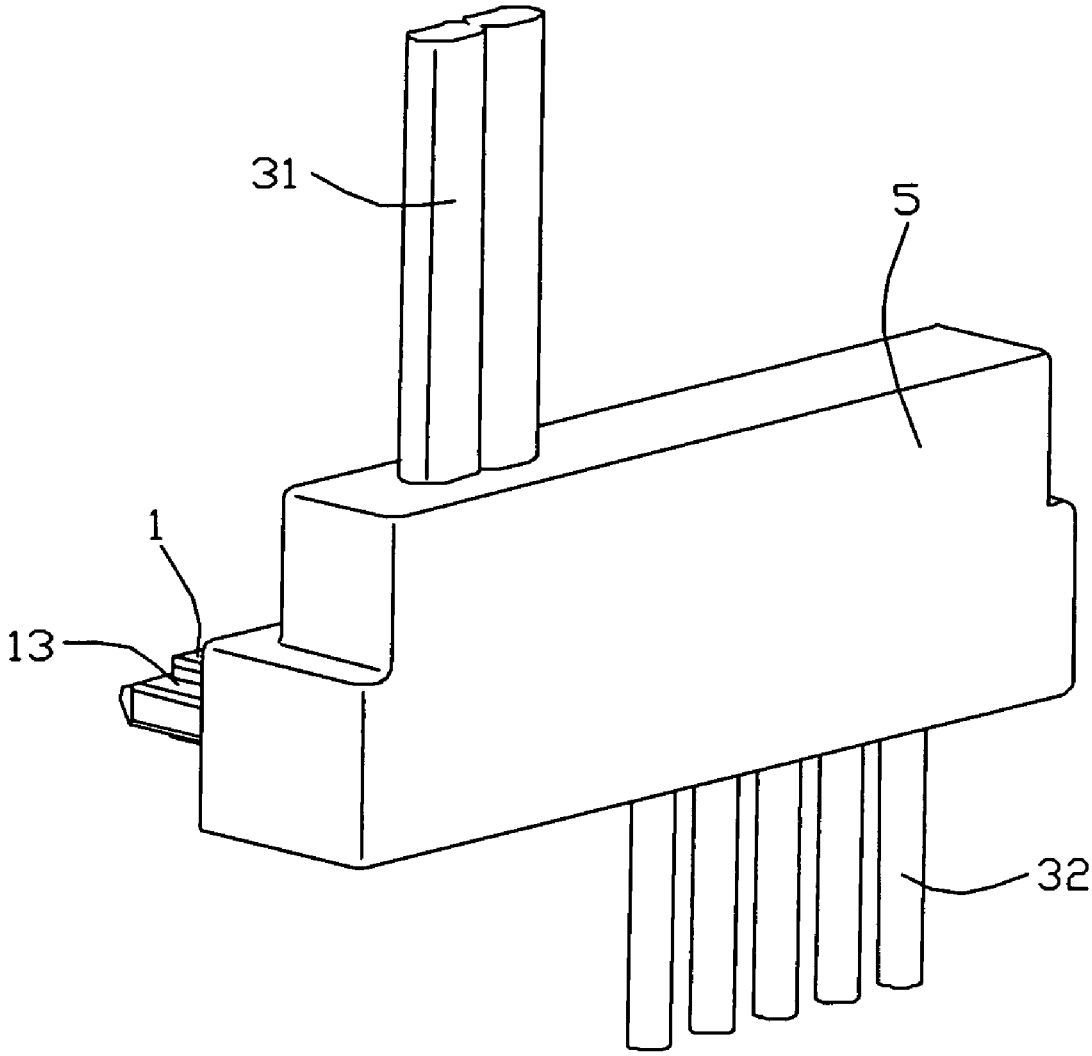
FIG. 2 is a view similar to FIG. 1, but viewed from a different aspect.
Figure 3:
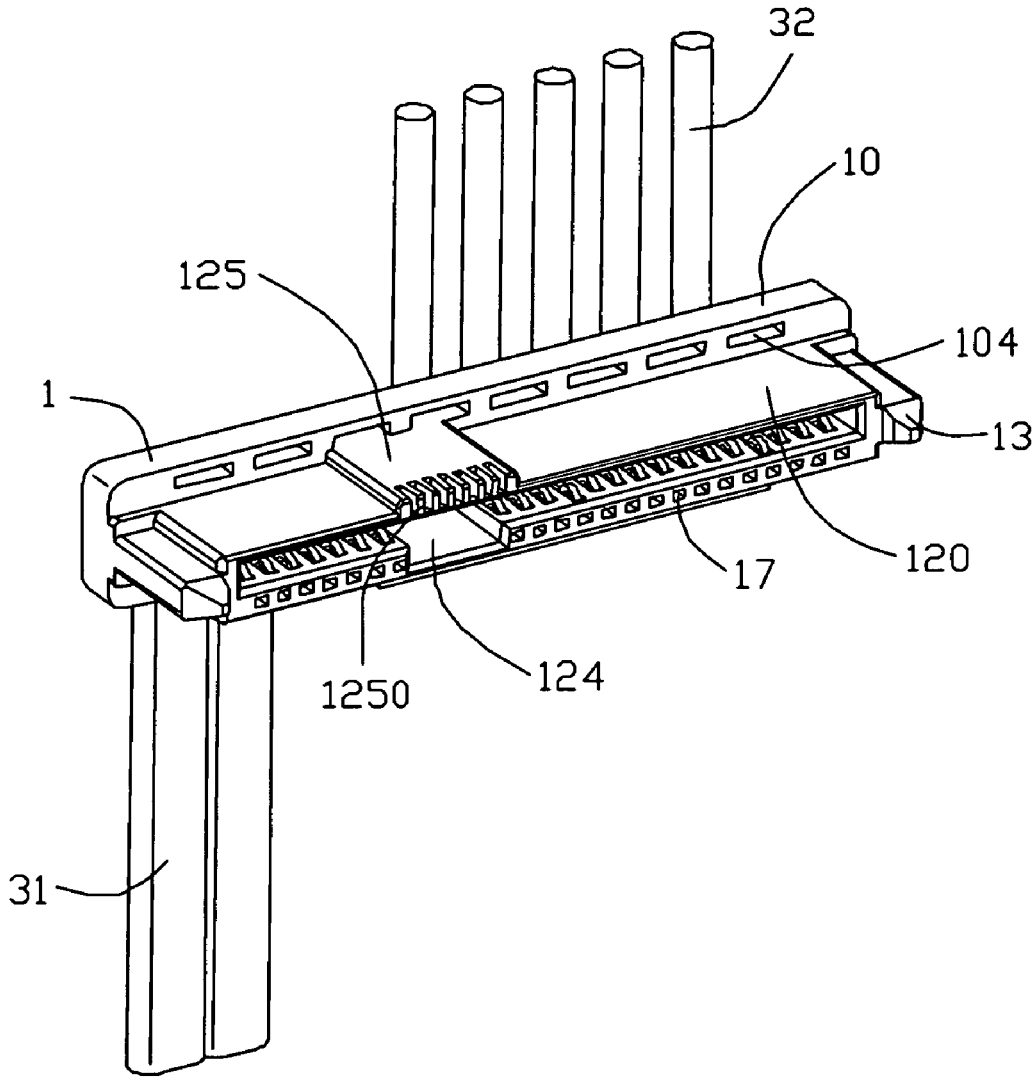
FIG. 3 is a partially assembled view of FIG. 1.
Figure 4:
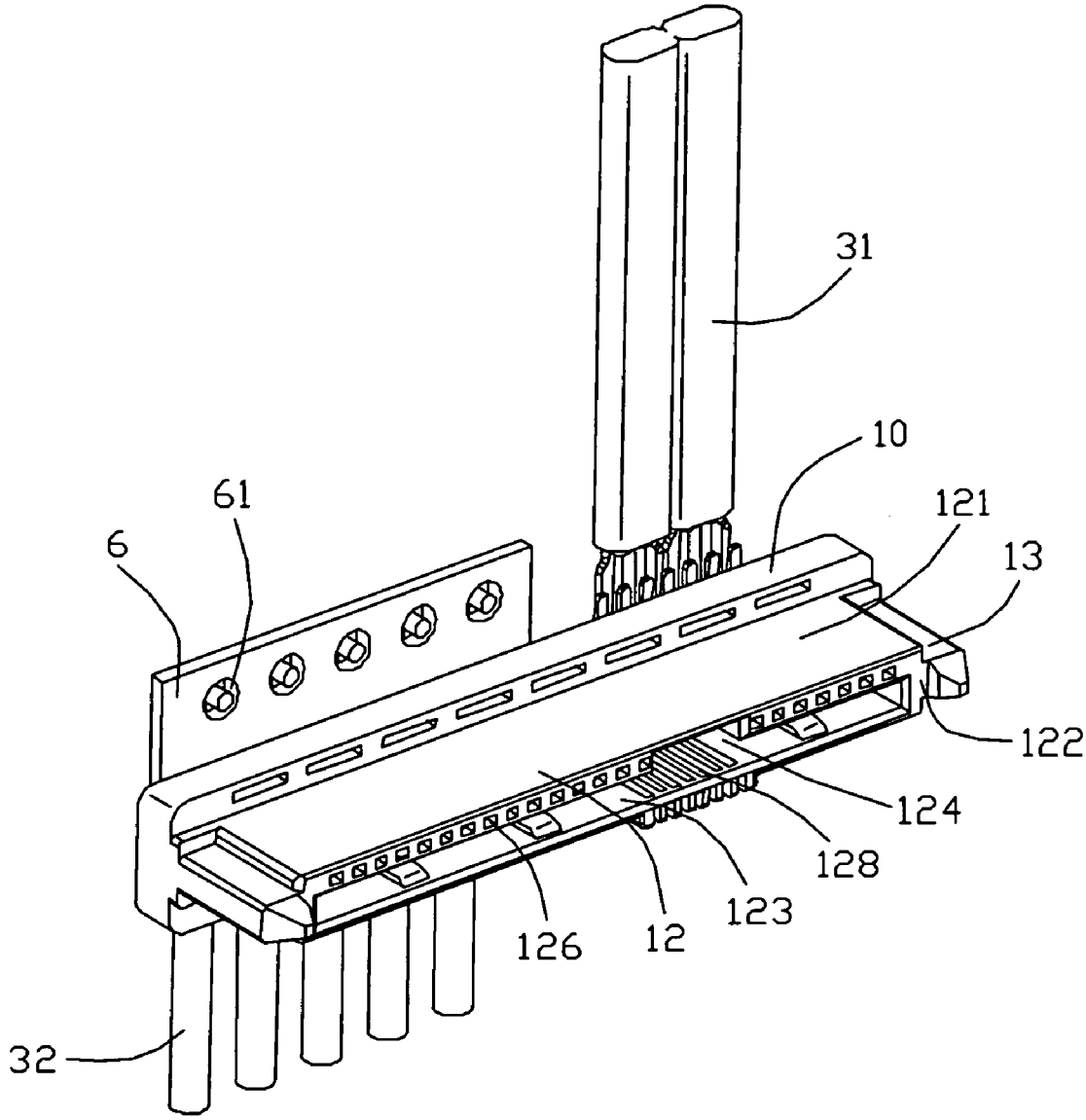
FIGS. 4-6 are views similar to FIG. 3, but viewed from different aspects.
Figure 5:
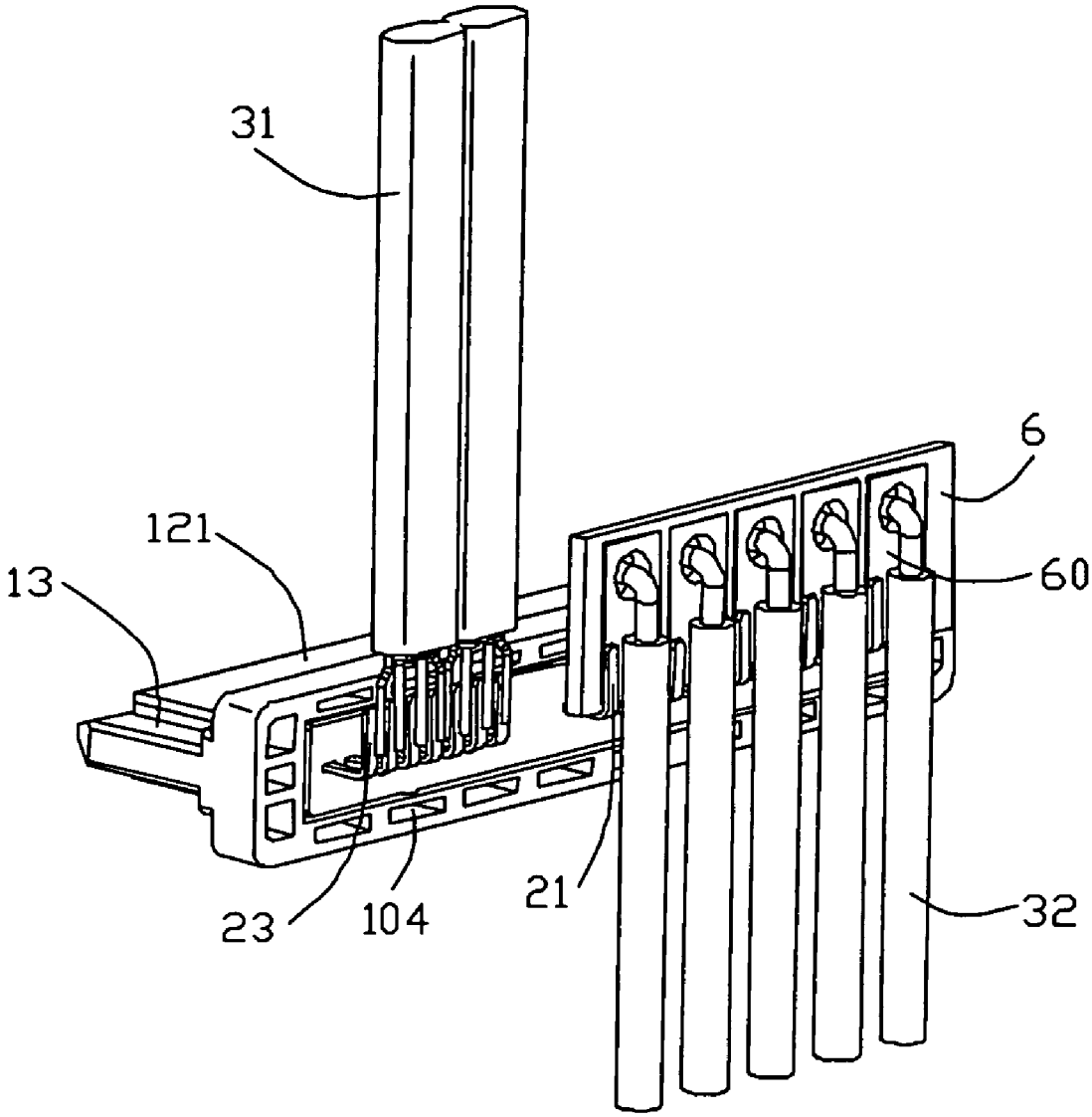
Figure 6:
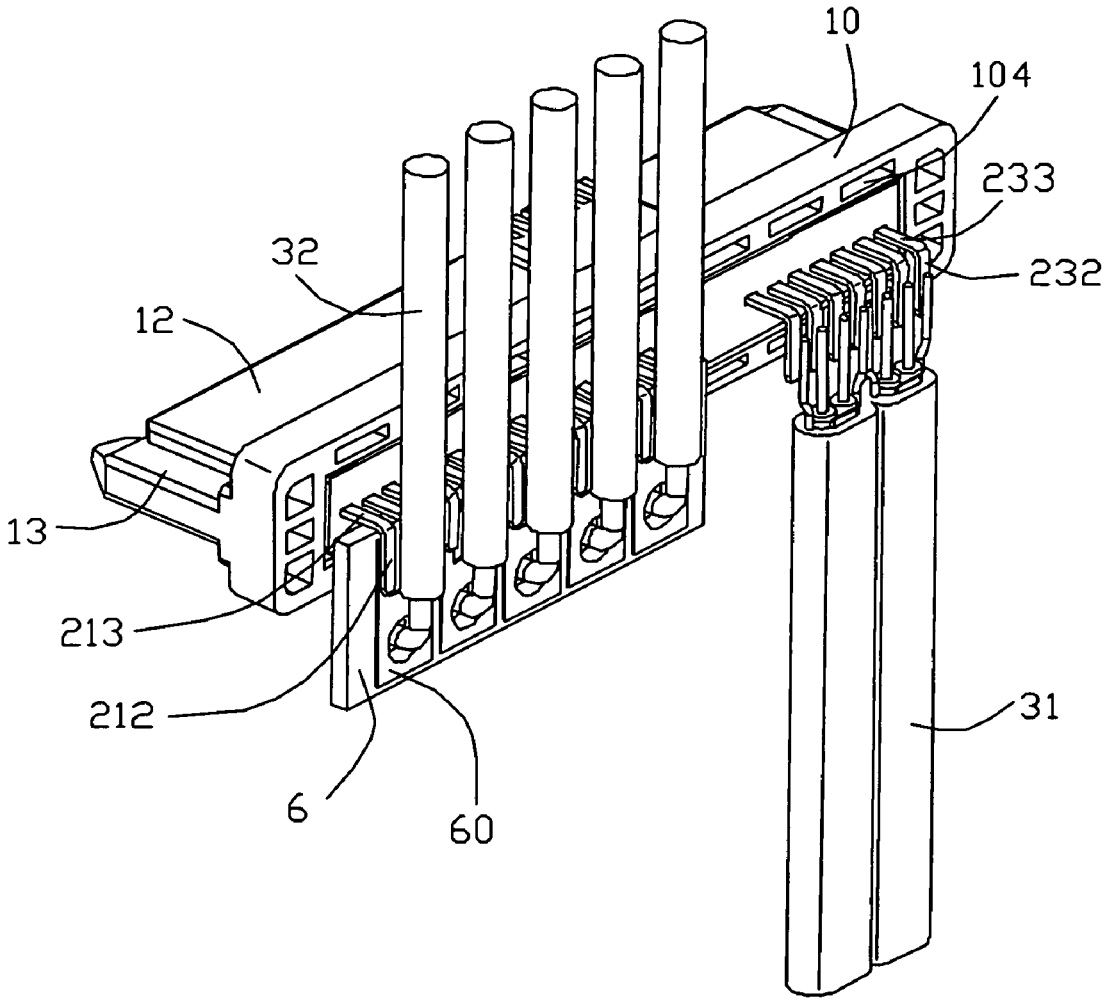

Reference will now be made to the drawing figures to describe the present invention in detail.

Figure 7:
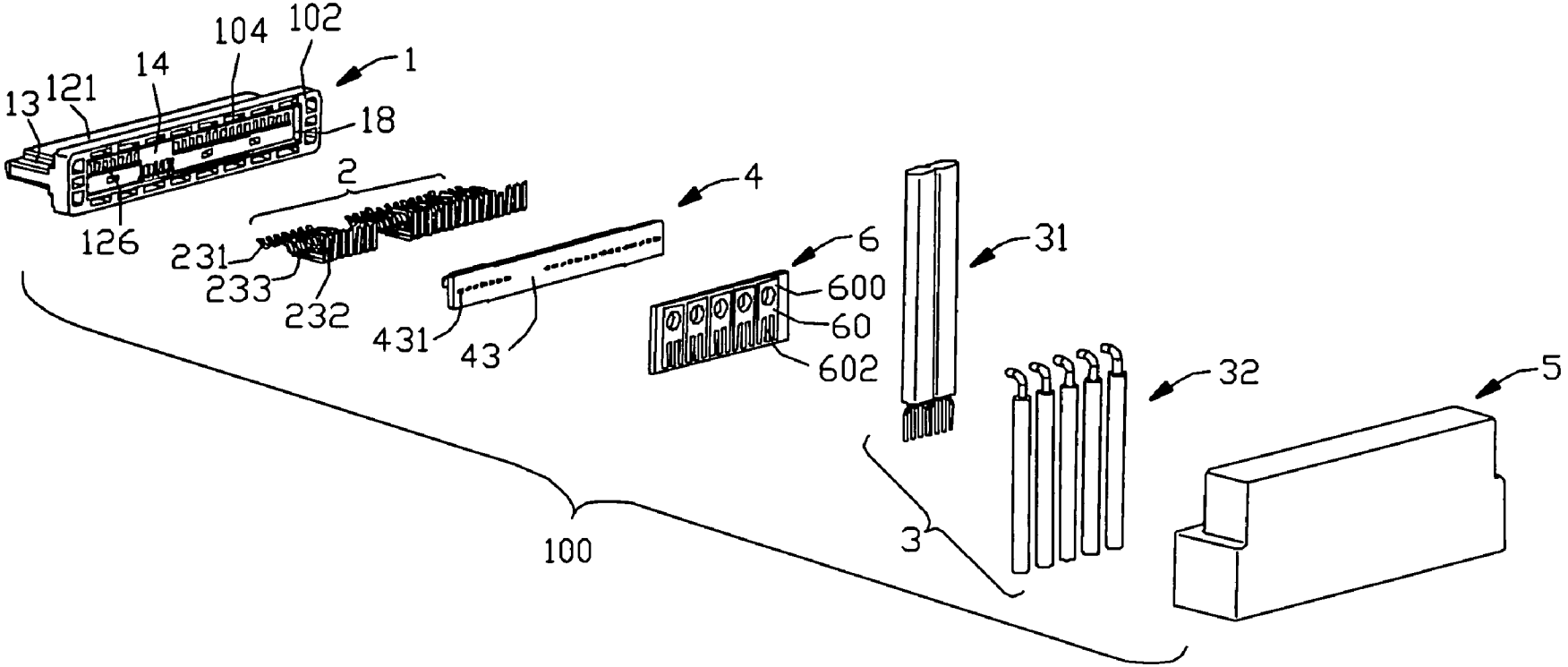
FIG. 7 is an exploded, perspective view of FIG. 1.
Figure 8:
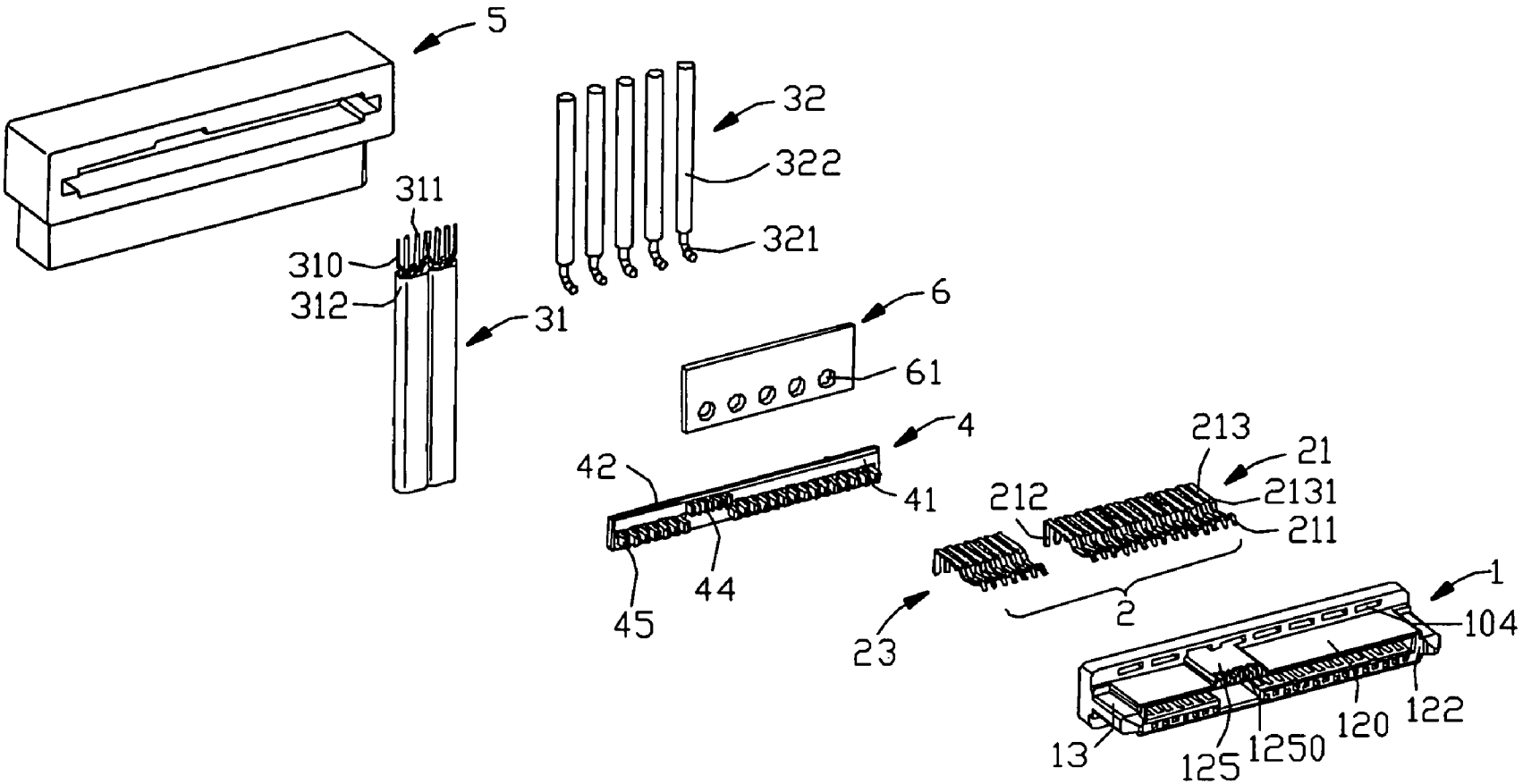
FIG. 8 is a view similar to FIG. 7, but viewed from a different aspect.
Figure 9:
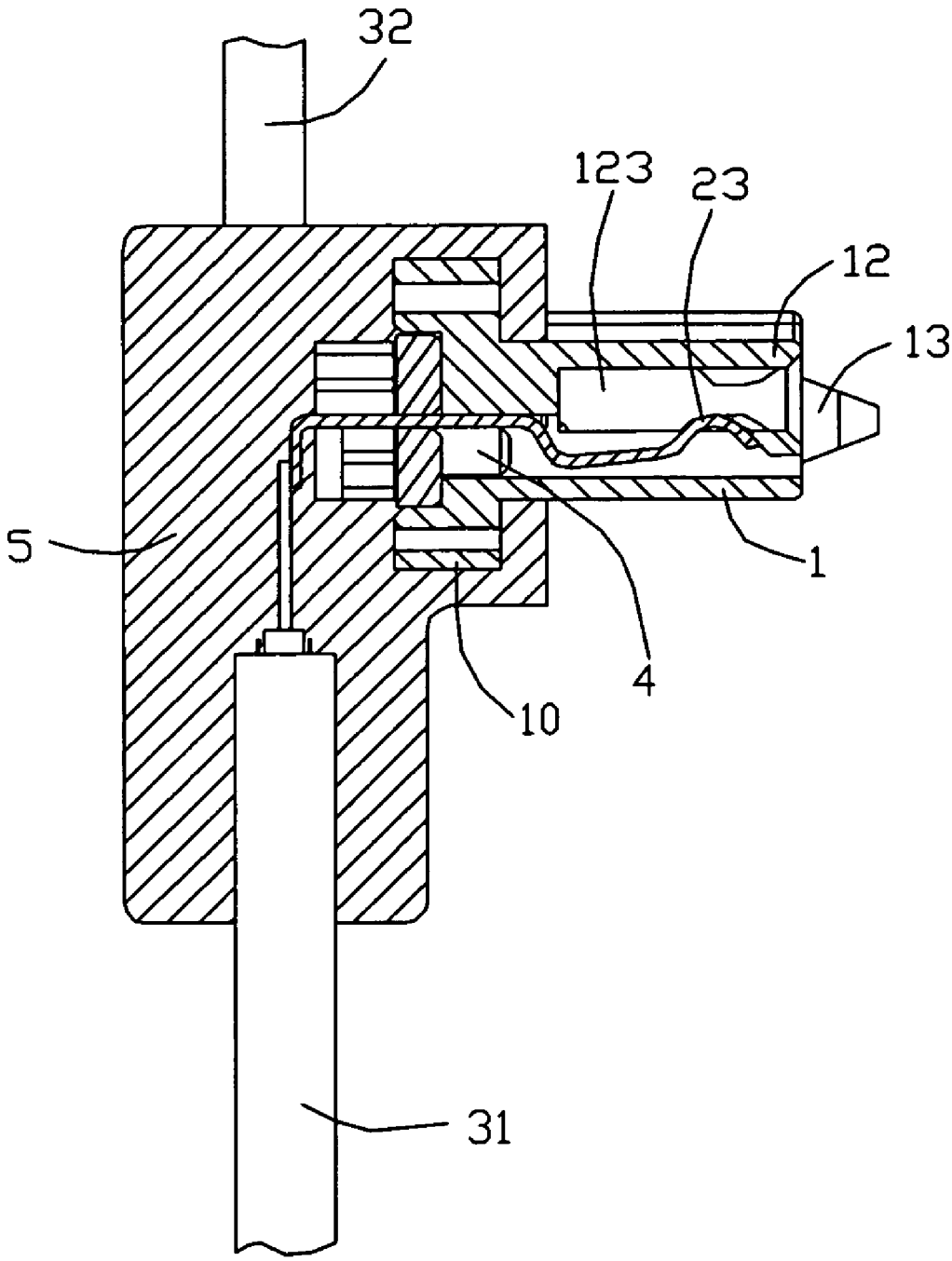
FIGS. 9-10 are cross-section views taken along lines 9-9 and 10-10 of FIG. 1.
Figure 10:
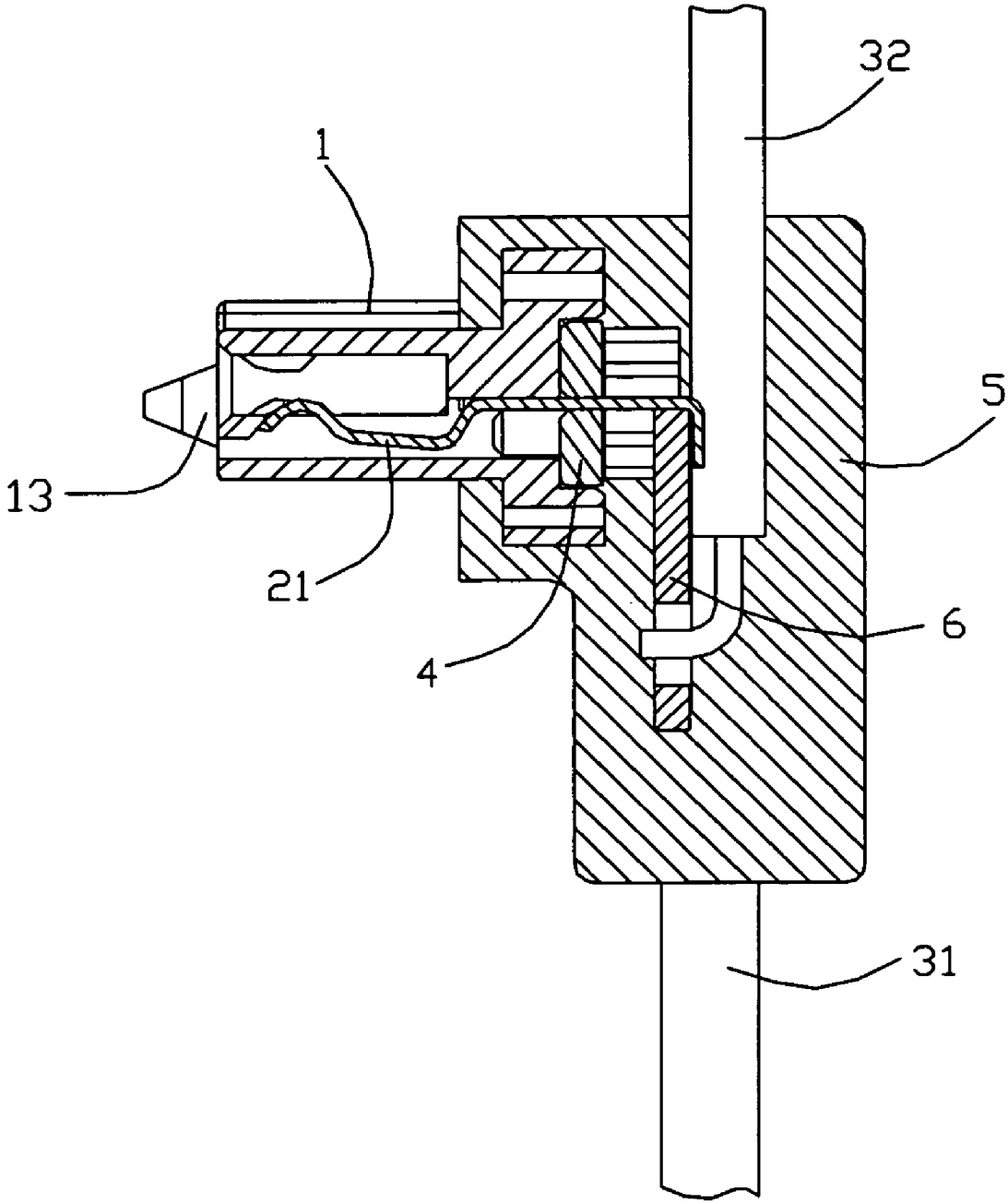

Referring to FIG. 1 and FIGS. 7-8, a plug connector 100 in accordance with the first embodiment of the present invention comprises an insulative housing 1, a plurality of contacts 2 housed in the insulative housing 1, a plurality of wires 3 electrically connecting with the contacts 2, a spacer 4 assembled to the insulative housing 1, a circuit board 6 positioned behind the spacer 4 and electrically connecting with the contacts 2 and the wires 3, and a cover 5 over-molded with the insulative housing 1.

Referring to FIGS. 3-6 and FIGS. 7-8, the insulative housing 1 comprises an elongated base portion 10 and a mating portion 12 extending forwardly from a center of the base portion 10 along a mating direction of the plug connector 100, that is the first direction. The base portion 10 defines two rows of opposed slots 104 and a rectangular opening 14 recessed forwardly from a rear surface 102 thereof. The opening 14 is located between the two rows of slots 104 along a vertical direction and communicates with the slots 104. The mating portion 12 comprises a first sidewall 120, a second sidewall 121 and a pair of opposed laterally extending end walls 122. The four walls together define a continuous central receiving cavity 123. A pair of guiding portions 13 extending forwardly from the base portion 10 are respectively arranged at opposite sides of the end walls 122. The second sidewall 121 defines a recess 124 recessed from an inner face thereof and communicating with the middle portion of the receiving cavity 123. The first sidewall 120 forms an expansion portion 125 on an exterior face thereof and aligned with the recess 124 along a vertical direction comprising opposite second and third directions. The recess 124 divides the second sidewall 121 into two different-dimension parts along elongated direction. The thickness of the first sidewall 120 is smaller than that of the second sidewall 121.

The second sidewall 121 defines a plurality of first passageways 126, the expansion portion 125 of the first sidewall 120 defines a plurality of second passageways 128. The first and second passageways 126, 128 penetrate through the insulative housing 1 along the mating direction. The expansion portion 125 defines a plurality of cutouts 1250 extending along the mating direction and respectively communicating with the second passageways 128.

The contacts 2 comprise a plurality of first and second contacts 21, 23 respectively received in the first passageways 126. The first contacts 21 are power contacts and consist of five sets of contact group each comprising three contacts, while, the second contacts 23 are signal contacts. The first contact 21 comprises a curved contacting portion 211, a tail portion 212 extending rearwardly and then bending downwardly, and a retention portion 213 connecting with the contacting portion 211 and the tail portion 212. A plurality of barbs 2131 are provided on opposite sides of the retention portion 213. The structure of the second contact 23 is same as that of the first contact 21, and also comprises a curved contacting portion 231, a tail portion 232 extending rearwardly then bending downwardly and a retention portion 233 connecting with the contacting portion 231 and the tail portion 232. The pin count numbers of the first and second contacts 21, 23 are different, the first contacts 21 comprise 15 contacts and the second contacts 23 comprise 7 contacts.

Referring to FIGS. 7-10, the longitudinally extending spacer 4 is substantially rectangular and the dimension thereof is substantially same as that of the rectangular opening 14 of the insulative housing 1. The spacer 4 comprises a front surface 41 and an opposed rear surface 43. A pair of tubers 42 are arranged on top edge of the spacer 4. The spacer 4 forms a plurality of second ribs 44 extending forwardly from the front surface 41 thereof and aligning with the second passageways 128 of the insulative housing 1. A row of first ribs 45 are located below the second ribs 44 along the vertical direction and arranged into two groups along lengthwise direction. The spacer 4 also defines a plurality through holes 431 aligning with corresponding first ribs 45.

The wires 3 comprise a signal cable 31 and a plurality of second wires 32. The signal cable 31 consists of two groups, each group comprises a pair of signal conductors 311 for transmitting signals of differential pair and a pair of grounding conductors 310 located at outer sides of the pair of signal conductors 311. Each signal cable 31 comprises a plurality of conductors 310, 311 and an outer jacket 312, the front ends of the conductors 310, 311 are exposed beyond the outer jacket. 312 and electrically connect with corresponding tail portions 232 of the contacts 2. The power wires 32 consist of five single-ended wires. Each power wire comprises at least one conductor 321 and an outer jacket 322. The signal cable 31 is arranged at one side of the base portion 10 and extends along the third direction perpendicular to the first mating direction of the mating portion 12 when soldered with the second contacts 23. The power wires 32 are spaced arranged at the other side of the base portion 10 and extend along the second direction opposite to the third direction and also perpendicular to the first mating direction of the mating portion 12.

The circuit board 6 comprises five sets of conductive traces 60 and a plurality of through holes 61 aligning with corresponding conductive traces 60 in the vertical direction. Each set of conductive traces 60 is of fork-shape and comprises a base section 600 and three fingers 602 extending from the base section 600 to electrically connect with corresponding contacts 2. The through holes 61 penetrate through the circuit board 6 and each through hole 61 is plated with conductive material for electrically connect the power wires 32 with corresponding conductive traces 60 when the power wires 32 soldered within the through holes 60.

Please refer to FIGS. 1-10, the first and second contacts 21, 23 are respectively assembled to the insulative housing 1 along the mating direction and received in the first passageways 126 of the insulative housing 1. The contacting portions 211, 231 of the contacts 21, 23 are exposed in the central receiving cavity 123, the retention portions 213, 233 interferentially engage with the first passageways 126, and the tail portions 212, 232 extend beyond the rear surface 102 of the insulative housing 1. The spacer 4 is assembled to the rear surface 102 of the insulative housing 1, while the circuit board 6 is disposed behind the rear surface 42 of the spacer 4. The second ribs 44 are inserted into the second passageways 128 to connect the spacer 4 with the insulative housing 2 and seal the rear ends of the second passageways 128. The spacer 4 is received in the rectangular opening 14 with the tubers 42 interferentially engaging with inner surfaces of the opening 14. The tail portions 212 of the first contacts 21 protrude through the through holes 431 and are then bent downwardly.

The three tail portions 212 of each set of first contacts 21 respectively solder with three fingers 602 of the same conductive trace 60 of the circuit board 6 to realize the multi-to-one electrical connection manner. The second contacts 23 respectively directly solder with corresponding signal and grounding conductors 310, 311 of the signal cable 31 in one-to-one manner. The conductors 321 of the power wires 32 are soldered into the through holes 61.

The cover 5 is of right-angle shape and is overmolded with the base portion 10, the solder area between the contacts 2 and the wires 3, the spacer 4 and the circuit board 6. Thus, the electrical connection between the contacts 2 and the wires 3 is enhanced. When molding the cover 5, the first and second ribs 45, 44 seal the passageways 126, 128 from the rear surface 102 of the insulative housing 1, melted material of the cover 5 cannot flow into the insulative housing 1. While, since the base portion 10 is enclosed by the cover 5, the two rows of slots 104 are filled by the material of the cover 5, thus enhancing the connection between the insulative housing 1 and the cover 5. After molding the cover 5, the power wires 32 extend upwardly from the horizontal portion of he cover 5, while the signal cable 31 extends downwardly from the vertical portion of the cover 5. The second passageways 128 of the expansion portion 125 are capable of receive corresponding contacts (not shown) to electrically match with SAS interface complementary connector or SATA interface complementary connector. In alternative embodiments, the second passageways 128 also can be omitted, and the remained expansion portion 125 can enhance the intensity of the first sidewall 120 and matches with SATA interface complementary connector.

Figure 11:
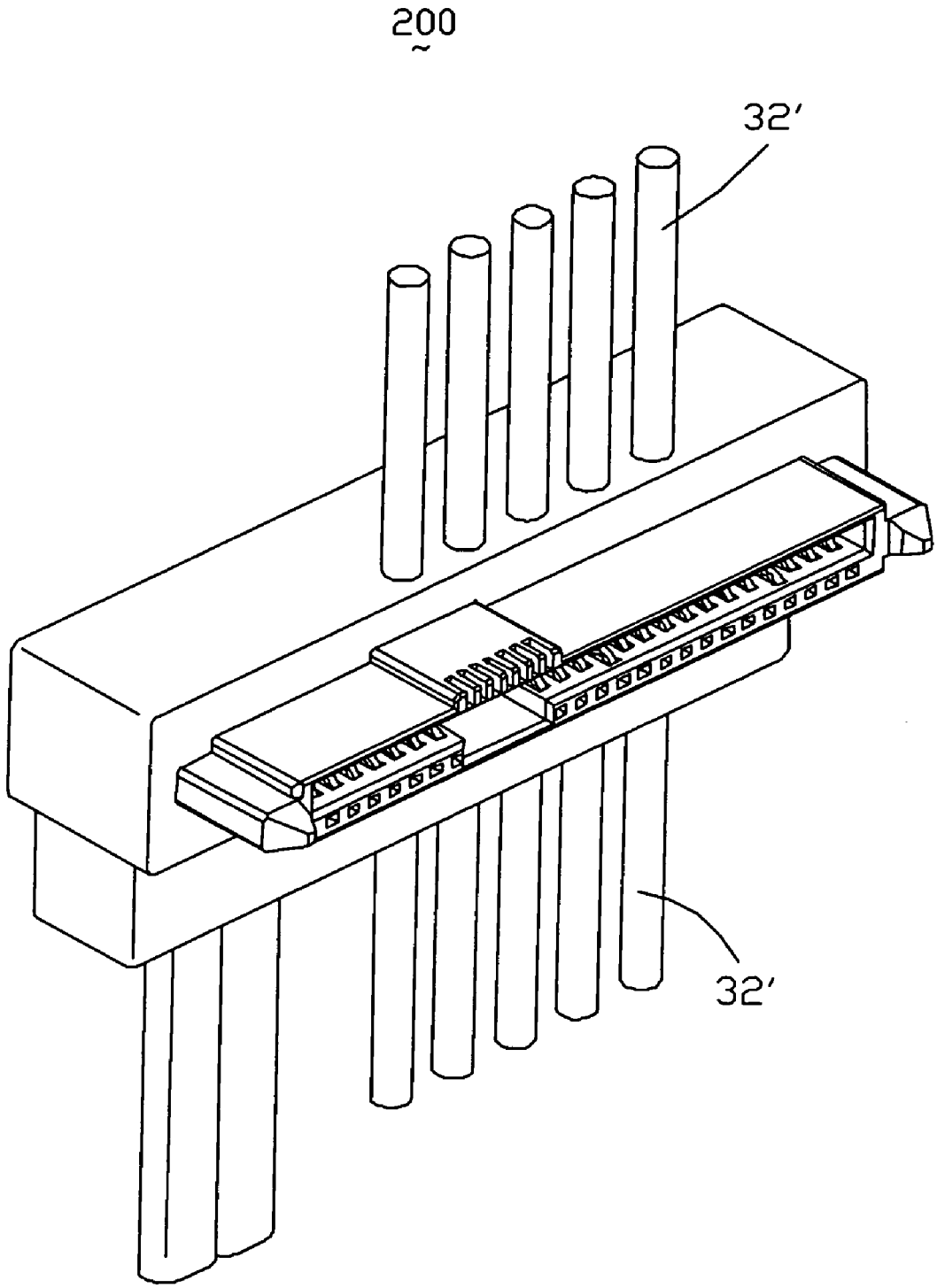
FIG. 11 is an assembled, perspective view of a plug connector in accordance with the second embodiment of the present invention.
Figure 12:
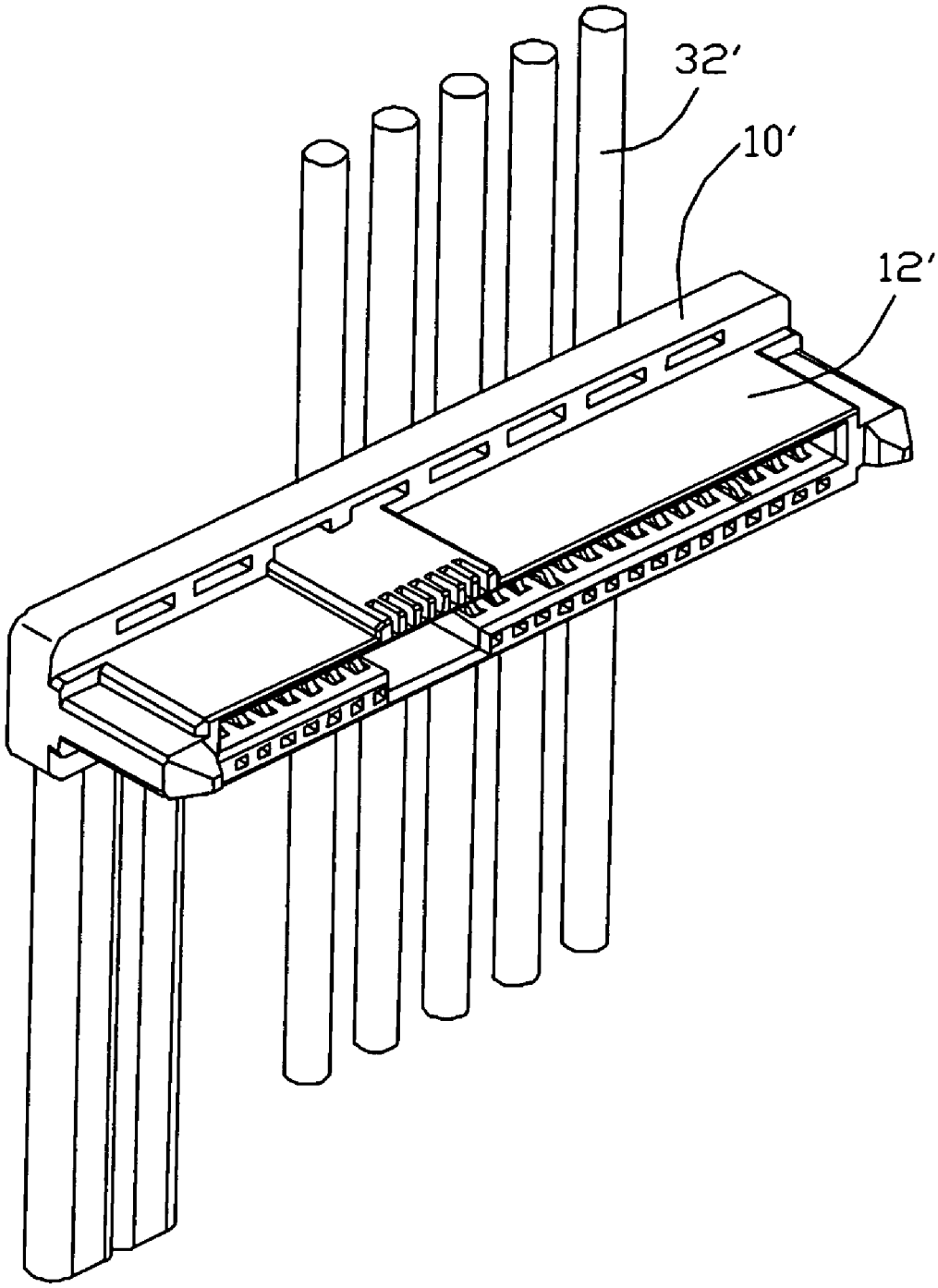
FIG. 12 is a partially assembled view of FIG. 11.
Figure 13:
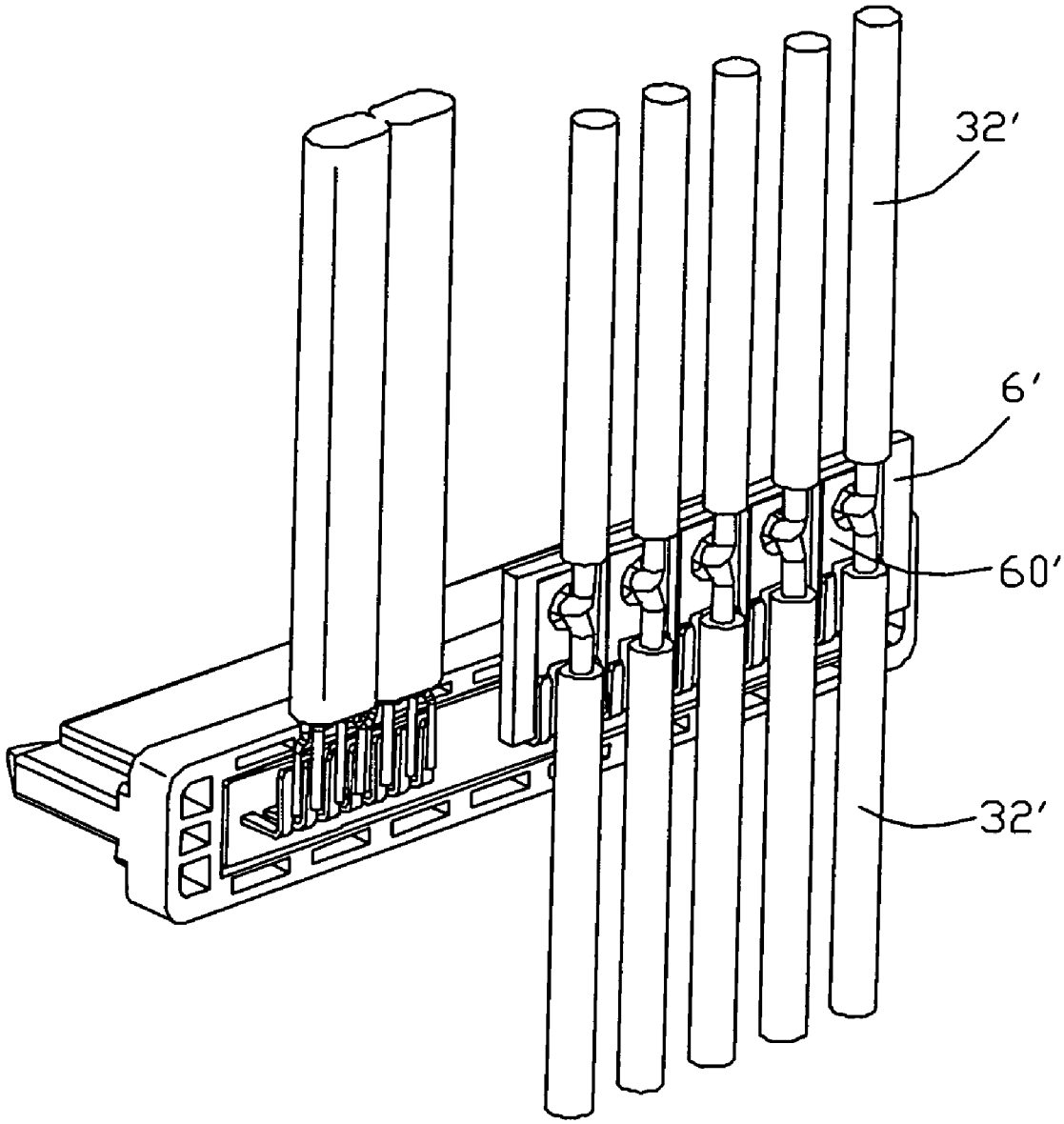
FIG. 13 is a view similar to FIG. 12, but viewed from a different aspect.

Please refer to FIGS. 11-13, a plug connector 200 in accordance with the second embodiment of the present invention have most elements and same structures of the plug connector 100 in accordance of the first embodiment. Compared with the plug connector 100, the arrangement of the power wires 32' of the plug connector 200 is different. The power wires 32' comprise a pair of same groups, each group comprises five power wires 32'. The two-group power wires 32' are arranged at two opposite sides of the base portion 10' and extend along opposite first and second directions perpendicular to the first mating direction of the mating portion 12'. The two-group power wires 32' are in mirror-image relative to the base portion 10' along the vertical direction and each pair of power wires 32' aligned with each other are both soldered with the same through hole 61' of the circuit board 6'. In alternative embodiments, the signal cable also can be arranged into two groups and respectively extend out of the plug connector from opposite sides of the plug connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector, comprising:

an insulative housing comprising a base portion and a mating portion extending from the base portion in a first direction;

a plurality of contacts received in the insulative housing; and a plurality of wires comprising a plurality of signal wires and a plurality of power wires respectively electrically connecting with the contacts; wherein the signal wires and the power wires are both arranged to extend along opposite directions both perpendicular to the first direction of the mating portion to locate at opposite sides of the mating portion.

2. The plug connector as claimed in claim 1, wherein the signal wires comprise two groups, and wherein each group comprises a pair of signal conductors and a pair of grounding conductors located at opposite outer sides of the pair of signal conductors.

3. The plug connector as claimed in claim 1, further comprising a cover, and wherein the cover is overmolded with the base portion of the insulative housing and the connection area between the contacts and the wires.

4. The plug connector as claimed in claim 3, wherein the cover is of right-angle shape, and wherein the power wires extend upwardly from a horizontal portion of the cover, while the signal wires extend downwardly from a vertical portion of the cover.

5. The plug connector as claimed in claim 1, wherein the power wires comprise two same groups and respectively extend along the opposite directions to locate at opposite sides of the mating portion.

6. The plug connector as claimed in claim 1, wherein each pair of power wires aligning with each other electrically connects to the same contact.

7. The plug connector as claimed in claim 1, further comprising a circuit board, and wherein the circuit board comprises a plurality of conductive traces electrically connecting with the power wires and the contacts.

8. The plug connector as claimed in claim 7, the conductive trace is of fork-shape and comprises a base section electrically connecting with the power wire and at least one finger electrically connecting with corresponding contact.

9. The plug connector as claimed in claim 7, wherein the contacts comprise a plurality of signal contacts and power contacts, and wherein the power contacts respectively solder with fingers of corresponding conductive traces of the circuit board in one-to-one manner, while the signal contacts are soldered with corresponding wires directly.

10. The plug connector as claimed in claim 1, wherein the mating portion of the insulative housing comprises a first sidewall and a second sidewall, and wherein the thickness of the first sidewall is smaller than that of the second sidewall.

11. The plug connector as claimed in claim 10, wherein the first sidewall of the insulative housing forms an expansion portion, and wherein the second sidewall defines a recess aligned with the expansion portion along a direction parallel to said opposite directions.

12. The plug connector as claimed in claim 1, wherein the insulative housing defines a plurality of first and second passageways and an opening recessed forwardly from rear surface of the insulative housing and communicating with the first and second passageways.

13. The plug connector as claimed in claim 12, further comprising a spacer received in said opening of the insulative housing.

14. The plug connector as claimed in claim 1, wherein the plug connector has an interface both compatible with SAS interface and Serial ATA standard.

15. A plug connector comprising:

a unitary longitudinal insulative housing defining an uninterrupted central receiving cavity along a lengthwise direction, the central receiving cavity defining a middle portion in said lengthwise direction, said housing comprising opposite first and second sidewalls located at two elongated sides of said central receiving cavity, said second sidewall being thicker than the first sidewall in a transverse direction perpendicular to said lengthwise direction;

a recess recessed from an inner face of the second sidewall and in communication with the middle portion of the central receiving cavity along said transverse direction; and an expansion portion integrally formed on an exterior face of the first sidewall and in alignment with the recess in said transverse direction;

a plurality of contacts received in the second sidewall; and a plurality of signal and power wires respectively electrically connecting with the contacts; and wherein the signal and power wires are arranged to extend along opposite transverse directions perpendicular to said lengthwise direction to locate at opposite sides of the insulative housing.

16. The plug connector as claimed in claim 15, wherein the contacts comprise a plurality of signal contacts and a plurality of power contacts, and the signal wires respectively connecting with the signal contacts and the power wires respectively connecting with the power contacts, and wherein at least a pair of power wires are arranged to extend along said opposite transverse directions and electrically connect with the same power contact.

17. The plug connector as claimed in claim 15, wherein the plurality of contacts are disposed in the second sidewall except in the recess, and no contacts are located in the first sidewall except in the expansion portion.

18. A plug connector comprising:

an insulative housing defining a common mating cavity along a longitudinal direction thereof and communicating with an exterior in a front-to-back direction;

first and second sets of contacts disposed in the housing and having mating sections exposed into the mating cavity and mounting sections extending rearwardly outside of the housing;

a first set of cables which electrically connect to the mounting sections of the first set of contacts, extending along a first horizontal direction perpendicular to both said longitudinal direction and said front-to-back direction;

a second set of cables which electrically connect to the mounting sections of the second set of contacts, extending along a second horizontal direction perpendicular to both said longitudinal direction and said front-to-back direction and opposite to the first direction;

wherein the second set of cables connect to the corresponding second set of contacts via a printed circuit board which is located on one side of the housing in said first direction.

19. The plug connector as claimed in claim 18, wherein said the mounting sections of both said first and second sets of contacts extend in the first horizontal direction.

* * * * *